US005513503A

United States Patent [19]

Gray et al.

[11] Patent Number: 5,513,503

[45] Date of Patent: May 7, 1996

[54] STRAND GUIDING DEVICE FOR CIRCULAR KNITTING MACHINES

[75] Inventors: Ed Gray; Horst Hesshaus, both of Greensboro, N.C.

[73] Assignee: Guilford Mills, Inc., Greensboro, N.C.

[21] Appl. No.: 100,684

[22] Filed: Aug. 2, 1993

[51] Int. Cl.[6] ..... D04B 3/06

[52] U.S. Cl. ..... 66/125 R

[58] Field of Search ..... 66/125 R, 132 R, 66/132, 146, 136, 137; 242/155 R, 47.01; 112/254

[56] References Cited

U.S. PATENT DOCUMENTS

| | | | |
|---|---|---|---|
| 607,798 | 7/1898 | Hurley | 66/146 |
| 752,666 | 2/1904 | Gormly | 66/146 |
| 2,098,050 | 11/1937 | Lawson et al. | 66/146 |
| 2,252,637 | 8/1941 | Lawson | 66/146 |
| 3,589,146 | 6/1971 | Schmidt | 66/125 R |
| 3,677,036 | 7/1972 | Hatay | 66/125 R |
| 3,800,564 | 4/1974 | Carswell | 66/146 |
| 4,233,825 | 11/1980 | Glaspie | 66/125 A |
| 4,481,794 | 11/1984 | Sawazaki | 66/132 T |

*Primary Examiner*—C. D. Crowder
*Assistant Examiner*—Larry D. Worrell, Jr.
*Attorney, Agent, or Firm*—Shefte, Pinckney & Sawyer

[57] ABSTRACT

A strand guiding device for use with a circular knitting machine for guiding strand material from a plurality of strand material packages to a generally circular array of reciprocating knitting needles movably mounted to the frame includes a support mounted to the frame and a pair of guide wheels rotatably mounted to the support and having a generally V-shaped strand contract surface formed therein for directing the traveling strands from the packages into a disposition for operational engagement by the knitting needles, the wheels being disposed in a spaced relationship in generally linear alignment and adjustably mounted to the support.

8 Claims, 4 Drawing Sheets

STRAND GUIDING DEVICE FOR CIRCULAR KNITTING MACHINES

BACKGROUND OF THE INVENTION

The present invention relates broadly to devices for guiding traveling strands in textile machines and, more particularly, to a strand guiding device for use in circular knitting machines.

As is known, circular knitting machines produce tubular knitted fabric for use by clothing manufacturers. Such knitting machines basically include a rotatable needle cylinder with axial needle slots formed in spaced relation to one another about the outer circumferential surface of the cylinder. A plurality of latch type knitting needles, each having a yarn receiving hook and a closable latch assembly, are reciprocably disposed within the axial cylinder slots. The knitting machine has a plurality of knitting stations positioned for movement into and out of yarn feeding disposition adjacent the upper end of the needle cylinder to feed yarn to the needles thereat. The needles are operatively manipulated within their respective slots of the cylinder by stationary cams positioned adjacent the cylinder to engage and act on cam lobes formed on the needles during the rotation of the needle cylinder. An appropriate control drum or similar control arrangement of a conventional construction is provided on the machine for determining the necessary transitional changes in the machine operation to form the knitted fabric.

During knitting operations, fabric, in the form of fibrous thread strands, is fed from a multiplicity of packages disposed circumferentially around and outboard of the knitting machine for feeding the strand material into a disposition for engagement with the latching assembly of the knitting needles. Current strand guiding devices comprise eyelets mounted to support members through which the strand is directed. The diameter of the eyelets is typically much greater than the strand size so that the traveling strand experiences chaotic laterally displacing movement within the eyelet as it travels therethrough during ongoing knitting operations.

Modern stretch knit fabrics are typically formed of cotton or other non-stretchable fabric strands interknitted with a synthetic elasticized fiber during knitting operations. The preferred synthetic elastic fiber is known commercially as LYCRA®, produced by E. I. DuPont de Nemours & Co. of Wilmington, Del. LYCRA® is relatively expensive when compared to cotton or other fibers and is also relatively thin in cross-section. Accordingly, any disruption of the knitting process when knitting LYCRA® with other materials can cause irregularities in the finished product. Further, the LYCRA® fibers, due to their elasticity and diminutive cross-sectional size, are more difficult for the latching assembly of needles to engage. If the latches cannot engage the fibers, knitting operations are disrupted for a period of time while the problem is corrected which reduces the efficiency of the knitting operation.

Conventional strand guides do not work well with LYCRA® fibers. The large opening of the eyelet and the aforesaid chaotic motion of the traveling strand make it even more difficult for the latching assembly of the knitting needle to engage the strand. Further, frictional contact of the LYCRA® traveling over the eyelet's inner surface can damage the traveling strand. Abrasion of the strand may result in reduced product quality while strand breakage may reduce overall operational efficiency.

SUMMARY OF THE INVENTION

It is accordingly an object of the present invention to provide a strand guiding device which addresses the above-discussed problems. It is specifically an object of the present invention to provide a strand guiding device for use with a circular knitting machine for guiding traveling strand material from a plurality of strand material packages to a generally circular array of reciprocating knitting needles movably mounted to a frame.

According to the preferred embodiment of the present invention, the strand guiding device includes a support mounted to the frame and a plurality of guide wheels rotatably mounted to the support in generally linear alignment and disposed in a spaced relationship for directly traveling strand material from the packages into a disposition for operational engagement by the knitting needles. It is preferred that the present invention include a pair of guide wheels having a generally V-shaped strand contract surface formed therein for guiding the traveling strand thereover, and formed of a phenol-formaldehyde resin, commercially available as BAKELITE®, from Georgia-Pacific Resins of Atlanta, Ga. The wheels are preferably formed with an axle passageway through generally the radial center thereof, the passageway being flared radially outwardly adjacent the outer surface of the wheel.

Preferably the support includes a base and a wheel support member having an axle formed therewith and having at least one wheel rotatably disposed on the axle, the mounting member being adjustably mounted to the base for selectively positioning the wheel to enhance the ability of the wheel to align and position the strand with respect to the knitting needles. The wheels may be retained on the axles by a wheel retaining member formed with a passageway therein, the passageway being configured for insertion and frictional retention of the axle therein. Preferably, the passageway formed in the wheel retaining member is flared outwardly adjacent the outer surface thereof. It is further preferred that the axle be coated with a chemical deposition of nickel phosphorus impregnated with polymers for enhanced wear resistance and to provide a low friction surface over which the wheels rotate. The chemical deposition of nickel phosphorus impregnated with polymers is commercially available as POLY-OND® and is available from Poly Plating of Chicopee, Mass.

By the above, the present invention provides an improved guiding device for traveling strands of material, especially synthetic elastic fibrous material, commonly known as LYCRA®. LYCRA® is commercially available from E. I. DuPont de Nemours and Co. of Wilmington, Del. The present invention enhances the operational capability of circular knitting machines when using fibers which are delicate, expensive or both by improving the positioning of the fiber with respect to the reciprocating knitting needles.

DETAILED DESCRIPTION OF THE PREFERRED EMBODIMENT

Figure 1:
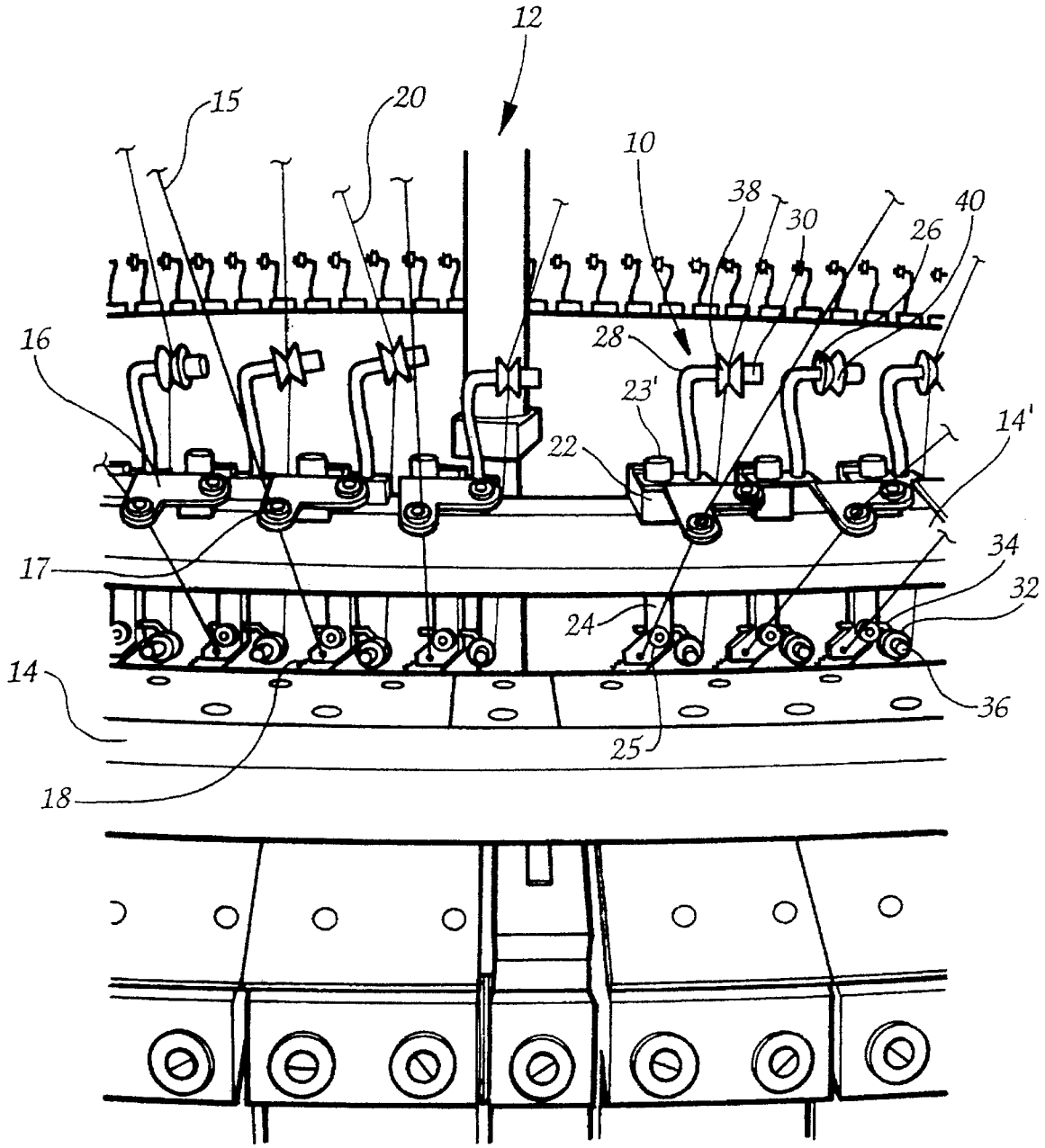
FIG. 1 is a partial side view of a circular knitting machine showing a plurality of strand guiding devices according to the preferred embodiment of the present invention mounted thereto.

Referring now to the accompanying drawings, and particularly to FIG. 1, a strand guiding device according to the preferred embodiment of the present invention is illustrated generally at 10 and shown in FIG. 1 mounted to a circular knitting machine 12 of the type previously described. Basically, the circular knitting machine 12 includes a plurality of strand guiding devices 10 mounted to the frame 14 of the knitting machine 12 in a circular array. A mounting ring 14' which is mounted to the frame 14 of the knitting machine 12 provides a platform on which to mount the strand guiding devices 10. A plurality of knitting needles 18 are movably mounted to the mounting ring 18' and are disposed adjacent the strand guiding devices 10. A plurality of cotton fiber strands 15 are shown being directed toward the knitting needles 18 by conventional guiding members 16. The convention guiding members 16 include an eyelet 17 through which the cotton fiber 15 may pass when-traveling to the knitting needles 18. LYCRA® fibers 20 are shown being guided across the strand guiding devices 10 of the present invention toward the knitting needles 18. Operation of the strand guiding devices 10 of the present invention will be explained in greater detail hereinafter.

Figure 2:
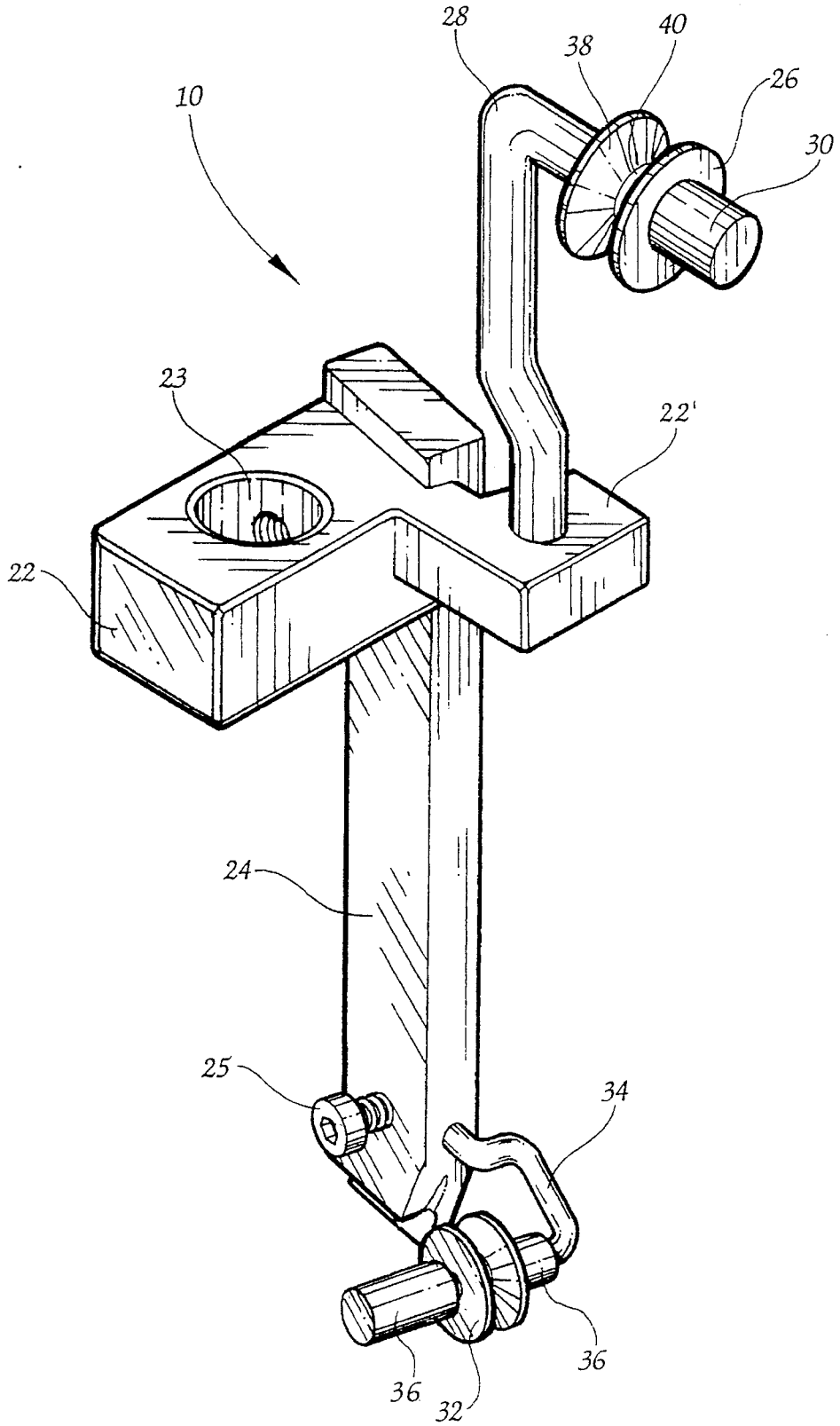
FIG. 2 is a perspective view of the strand guiding device illustrated in FIG. 1.
Figure 3:
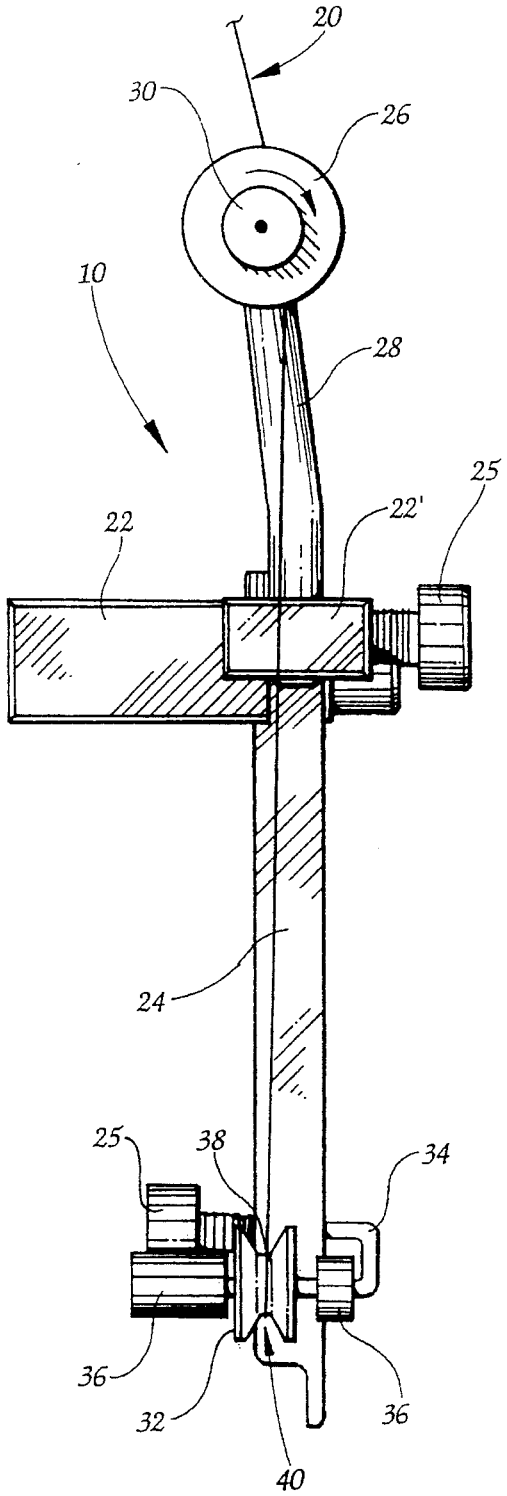
FIG. 3 is a front view of the strand guiding device.

Referring now to FIG. 2, the strand guiding device 10 basically includes a base member 22 having a mounting opening 23 formed therein. The base member 22 is formed as a generally rectangular metallic block having a generally rectangular axle support mounting portion 22' formed integrally therewith and projecting laterally outwardly therefrom. A second axle support mounting portion 24 is formed as a generally rectangular elongate member and is mounted to the base 22 to project downwardly therefrom. A first upper wheel support rod 28 is formed as a generally hooked member projecting upwardly from the first support portion 22' and is adjustably mounted thereto. As best seen in FIG. 3, the upper wheel support rod 28 is fitted into an opening (not shown) in the first support portion 22' and a retaining screw 25 is threadedly engaged with another opening (not shown) formed in the first support portion 22'. The retaining screw 25 is threaded into the opening until it abuts the upper wheel support rod 28 and frictionally retains the upper wheel support rod 28 in the desired position.

Figure 5:
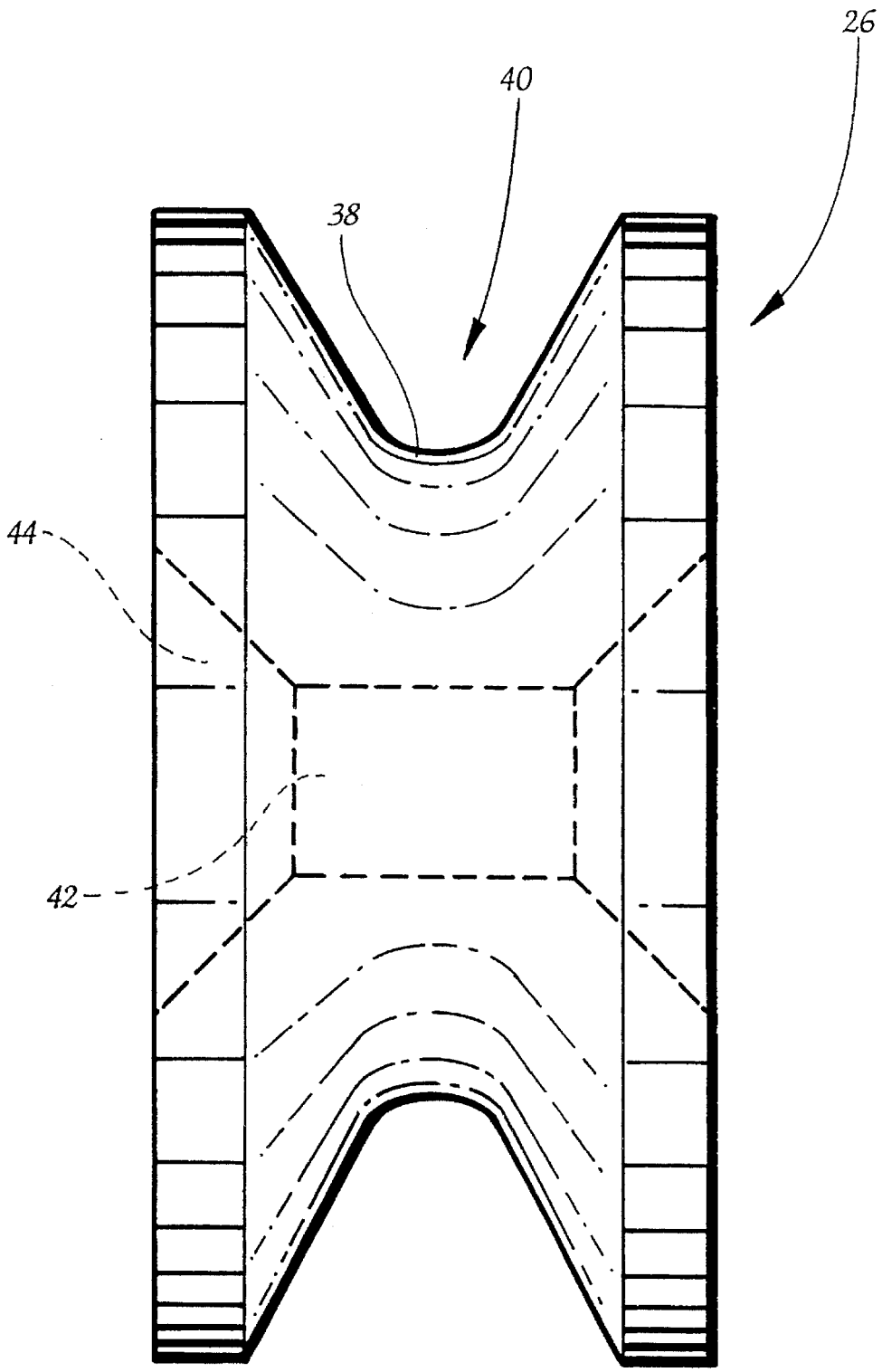
FIG. 5 is a side view of a guide wheel from the strand guiding device according to the preferred embodiment of the present invention.

An upper guide wheel 26 is rotatably mounted to the upper wheel support rod 28. While the upper wheel support rod 28 is illustrated as a relatively thick member, its distal end portion is rapidly decreased in diameter to form a wire-like axle onto which the wheel 26 is mounted. With reference to FIG. 5, it can be seen that a passageway 42 is provided in the wheel through which the axle may pass. Referring back to FIG. 2, a generally cylindrical stop member is mounted to the distal end of the upper wheel support rod 28 outwardly of the wheel 26 to frictionally retain the wheel in place. Construction of the wheel 26 will be explained in greater detail hereinafter.

A lower wheel support rod 34 is mounted to the lower support member 24 in the same general manner as the upper wheel support rod 28. Likewise, the position of the lower wheel support rod 34 may be altered in a manner described in relation to the upper wheel support rod 28. A second, lower guide wheel 32 is mounted to the lower wheel support rod 34 using generally cylindrical stop members 36 to position and frictionally retain the wheel 32 on the lower wheel support rod 34. Accordingly, the above-discussed construction provides two guide wheels 26,32 spaced a distance from each other in generally linear alignment, as will be explained in greater detail hereinafter.

One of the features of the present invention that provides superior performance when feeding LYCRA® or similar fibers is the wheel construction itself. Turning now to FIG. 5, a wheel 26 is illustrated. While FIG. 5 illustrates one wheel which is referenced as an upper wheel 26, both wheels 26,32 are constructed in basically the same manner. The features of the wheel 26 provide the strand guiding device 10 of the present invention with an enhanced ability to guide and direct the LYCRA® fibers and reduces the buildup of lint at the wheel hub. The wheel 26 is formed as a generally cylindrical member having a strand contact surface 38 formed circumferentially around the outer perimeter thereof. The strand contact surface 38 is formed with a generally parabolic groove 40 through which the strand passes when traveling over the wheel. This groove 40 serves to maintain the strand in proper alignment and reduces the chaotic movement of a rapidly traveling strand which was realized with the conventional strand guides.

Airborne lint is ever present in knitting operations and circular knitting machines are no exception. One of the problems associated with using wheels to guide the fabric is that airborne lint tends to accumulate at the junction of the axle and the wheel hub which can cause the wheel to jam and become unrotatable which in turn can cause the fibers to leave the groove 40 thereby disrupting knitting operations. The present invention reduces lint buildup in two ways. First, and with reference to FIG. 5, the passageway 42 through which the axle passes includes a flared portion 44 formed therein adjacent the flat surface of the wheel. Although not shown, the stop members 30,36 include similar flared portions formed therein. These flared portions tend to discourage the buildup of lint during wheel rotation. Additionally, the wheels 26,32 themselves are formed of a phenol-formaldehyde resin, available commercially as BAKELITE® from Georgia-Pacific Resins of Atlanta, Ga. The phenol-formaldehyde resin has a high resistivity property and, therefore, acts as an electric insulator. Accordingly, as the wheel rotates on the shaft the buildup of static electricity is minimal and therefore the attraction of lint is reduced as compared to other wheels. Accordingly, the wheels 26,32 of the present invention are formed to direct and guide traveling strands while enhancing the ability of the knitting machine to carry out on-going knitting operations.

To enhance the ability of the wheels 26,32 to rotate on the rods 28,34, the rods 28,34 are coated with a chemical deposition of nickel phosphorus, impregnated with polymers, on the surface of the metals. This coating is commercially available as POLY-OND® and is available from Poly Plating, Inc., of Chicopee, Mass. This coating provides continuous dry lubrication and is extremely long-wearing. The use of this coating greatly enhances the longevity of the present invention.

Figure 4:
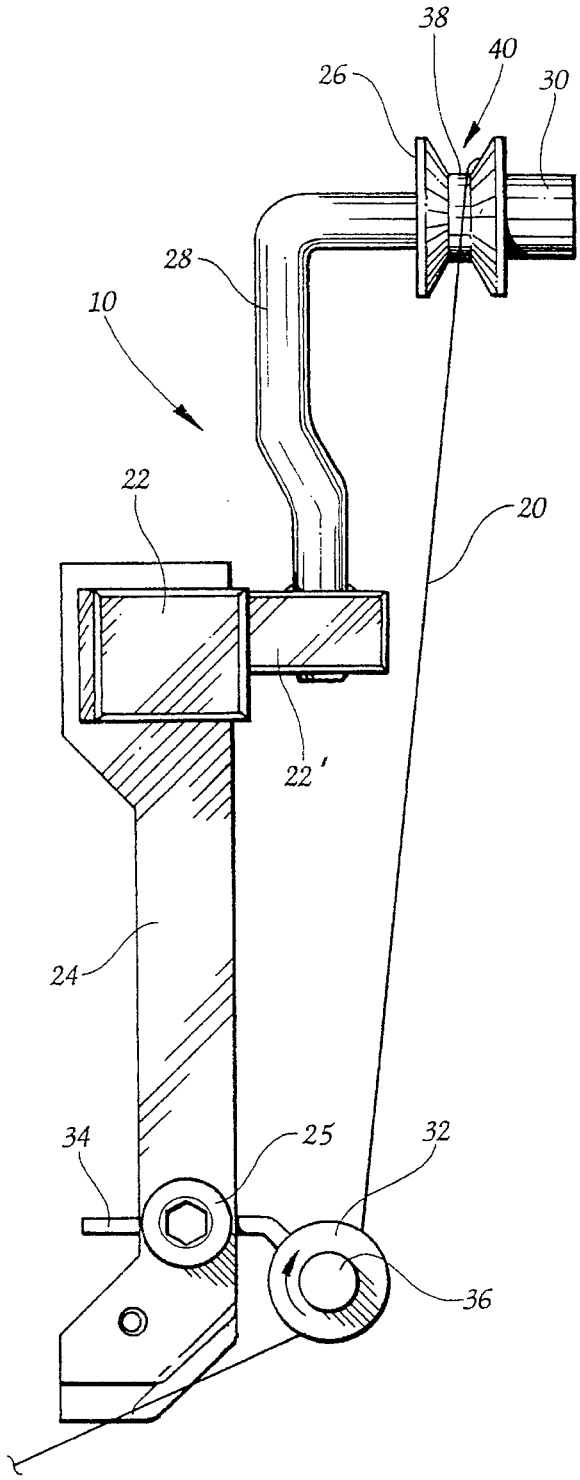
FIG. 4 is a side view of the strand guiding device.

Turning now to FIGS. 3 and 4, it can be seen that the wheels 26,32 are generally linearly aligned and are oriented in approximately an orthogonal manner with respect to rotation. A LYCRA® strand 20 is shown engaging the upper wheel 26 which rotates due to the friction of the strand passing thereacross. The strand 20 is directed downwardly toward the lower wheel and from there to the needles. The orthogonal nature of the wheel arrangement tends to maintain the strand in contact with both wheels 26,32. Any tendency of the strand 20 to ride out of one of the grooves 40 is counteracted by the contact of the strand 20 with the other wheel 26,32.

By the above, a traveling strand guiding device is provided which directs traveling strand material to the knitting needles in a more precise manner than has been previously achieved. Utilizing the present invention, the quality of the knitted material is improved. Experiments have shown that using conventional traveling strand guiding devices, a 14% rejection rate was seen in the finished product. With the present invention, the rejection rate is reduced down to approximately 1.5%. Further, experiments have shown that the present invention provides a 40% reduction in the time in which the machine is unable to function due to broken or displaced LYCRA® strands. While the present invention is particularly suited for use with LYCRA® and other synthetic elasticized fibers, benefits can be achieved using the device with other fibers as well.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A strand guiding device for use with a circular knitting machine for guiding traveling strand material traveling from a plurality of strand material packages to a generally circular array of reciprocating knitting needles movably mounted to a frame, said strand guiding device comprising:

support means for mounting to the frame;

a plurality of guide wheels mounted to said support means, at least one of said wheels being formed with an axle passageway through generally the radial center thereof and defined by walls which taper smoothly in a cone-like manner from an outer diameter formed in an outer surface of said at least one wheel to an inner diameter, said inner diameter being less than said outer diameter and slightly larger than a diameter of an axle, said wheels being disposed in a spaced relationship for directing traveling strand material from the packages into a disposition for operational engagement by the knitting needles.

2. A strand guiding device according to claim 1 wherein said support means includes at least one axle for mounting said wheels thereon, said wheels being retained on said axle by a wheel retaining member formed with a passageway therein, said passageway being configured for insertion and removal of said axle therein.

3. A strand guiding device according to claim 2 wherein said passageway of said wheel retaining member is flared outwardly adjacent an outer surface thereof.

4. A strand guiding device according to claim 1 wherein each said wheel includes a generally V-shaped strand contact surface formed therein for guiding the traveling strand thereover.

5. A strand guiding device according to claim 4 wherein said wheels are formed of a phenol-formaldehyde resin.

6. A strand guiding device according to claim 1 wherein said support means includes a base and a wheel support member having an axle formed therewith and having at least one wheel rotatably disposed on said axle, said mounting member having means for adjustably mounting said mounting member to said base for selectively positioning said wheel to enhance the ability of said wheel to align and position the strand with respect to the knitting needles.

7. A strand guiding device according to claim 6 wherein said wheels are retained on said axles by a wheel retaining member formed with a passageway therein, said passageway being configured for insertion and frictional retention of said axle therein.

8. A strand guiding device according to claim 6 wherein said axle is coated with a chemical deposition of nickel phosphorus impregnated with polymers for enhanced wear resistance and to provide a low friction surface over which the wheels rotate.

* * * * *

UNITED STATES PATENT AND TRADEMARK OFFICE

CERTIFICATE OF CORRECTION

PATENT NO. : 5,513,503

DATED : May 7, 1996

INVENTOR(S) : Ed Gray and Horst Hesshaus

It is certified that error appears in the above-identified patent and that said Letters Patent is hereby corrected as shown below:

In claim 6, line 4, delete "mounting" and insert therefor -- wheel support --.

Signed and Sealed this

Eleventh Day of March, 1997

*Attest:*

*Attesting Officer*

BRUCE LEHMAN

*Commissioner of Patents and Trademarks*